US006409076B1

(12) United States Patent
Wang

(10) Patent No.: US 6,409,076 B1
(45) Date of Patent: Jun. 25, 2002

(54) COMBINATION STORAGE BOX

(76) Inventor: Wen-Tsan Wang, P.O. Box 82-144, Taipei (TW)

( * ) Notice: Subject to any disclaimer, the term of this patent is extended or adjusted under 35 U.S.C. 154(b) by 0 days.

(21) Appl. No.: 10/006,149

(22) Filed: Dec. 10, 2001

(51) Int. Cl.[7] ..... B65D 5/42
(52) U.S. Cl. ..... 229/122.34; 229/166; 229/199
(58) Field of Search ..... 229/122.34, 166, 229/181, 198, 199; 206/425

(56) References Cited

U.S. PATENT DOCUMENTS 877,757 A * 1/1908 Comings ..... 229/122.34
1,103,646 A * 7/1914 Baddeley ..... 229/199
2,200,320 A * 5/1940 Zalkind ..... 229/199
2,739,754 A * 3/1956 Anderson, Jr. ..... 229/199
2,778,560 A * 1/1957 Pfeiffer ..... 229/166
2,947,462 A * 8/1960 Bostock ..... 229/199
3,784,083 A * 1/1974 Pfaffendorf et al. ..... 229/166
4,585,159 A * 4/1986 Travis ..... 229/166
4,948,039 A * 8/1990 Amatangelo ..... 229/198

* cited by examiner

*Primary Examiner*—Gary E. Elkins
(74) *Attorney, Agent, or Firm*—Leong C. Lei

(57) ABSTRACT

A combination storage box is constructed to include a collapsible box body, a hard bottom plate fitted into the box body, a folding collapsible support frame inserted into the box body to support the box body in shape, and hook and loop materials fixedly provided in the box body and adapted for securing the folding collapsible support frame to the inside of the box body in the working position.

1 Claim, 4 Drawing Sheets

COMBINATION STORAGE BOX

BACKGROUND OF THE INVENTION

1. Field of the Invention

The present invention relates to storage boxes and, more particularly, to a combination storage box that can be collapsed when not in use.

2. Description of the Related Art

Conventional storage boxes occupy much storage space during delivery because they are not folding collapsible. There is known a folding collapsible storage box, which comprises a collapsible fabric box body, four horizontal rod members respectively embedded in the top sides of the four vertical side panels of the box body, two horizontal rod member respectively embedded in the bottom sides of two opposite vertical side panels of the box body, four vertical rod members respectively embedded into the box body in four corners between each two adjacent vertical side panels, and four sets of triangle plates respectively fixedly fastened to the vertical side panels of the box body. When not in use, the box body is twisted into a collapsed condition. The triangle plates guide the twisting action, enabling the box body to be easily twisted into the collapsed condition. This structure of folding collapsible storage box is functional, however it is complicated and expensive to manufacture.

SUMMARY OF THE INVENTION

The present invention has been accomplished under the circumstances in view. It is one object of the present invention to provide a combination storage box, which can easily be set up when in use, or collapsed in a flat manner to minimize space occupation when not in use. It is another object of the present invention to provide a combination storage box, which is easy and inexpensive to manufacture. According to one aspect of the present invention, the combination storage box assembly comprises a collapsible box body made of flexible material, for example, canvas, a hard bottom plate fitted into the box body, a folding collapsible support frame inserted into the box body to support the box body in shape, and hook and loop materials fixedly provided in the box body and adapted for securing the folding collapsible support frame to the inside of the box body in the working position. According to another aspect of the present invention, the folding collapsible support frame is comprised of a rectangular open base frame, and two U-shaped foot frame bars. The rectangular open base frame comprises two pairs of downward lugs respectively downwardly extended from two distal ends of each of two opposite short sides thereof. The U-shaped foot frame bars are respectively pivoted to the downward lugs, and turned relative to the rectangular base open frame between a first position where the U-shaped foot frame bars are closely attached to the rectangular open base frame, and a second position where the U-shaped foot frame bars are maintained perpendicular to the rectangular base frame and arranged in parallel.

DETAILED DESCRIPTION OF THE PREFERRED EMBODIMENT

Figures 1, 1A:
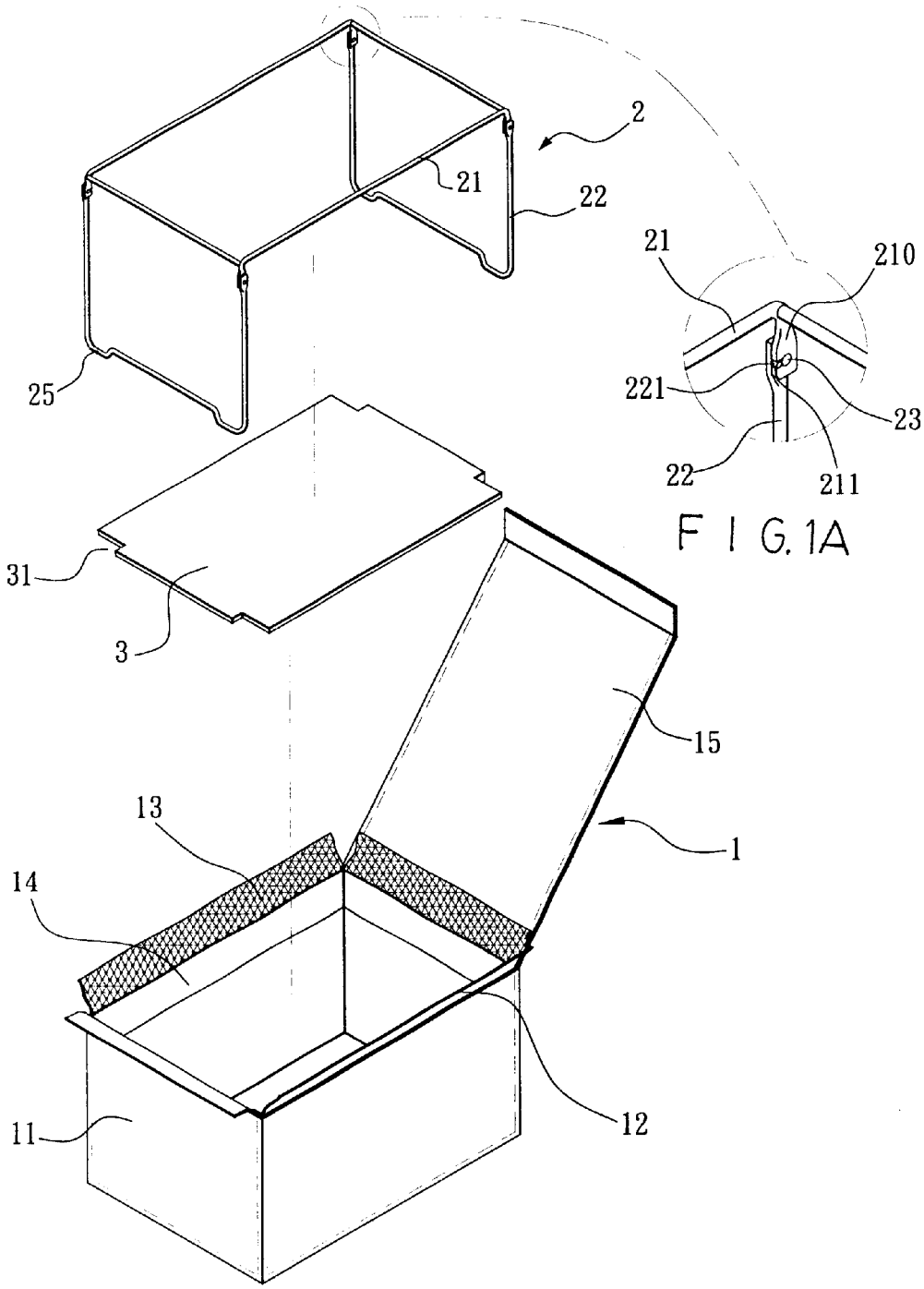
FIG. 1 is an exploded view of a combination storage box constructed according to the present invention.
FIG. 1A is an enlarged view of a part of FIG. 1.
Figure 2:
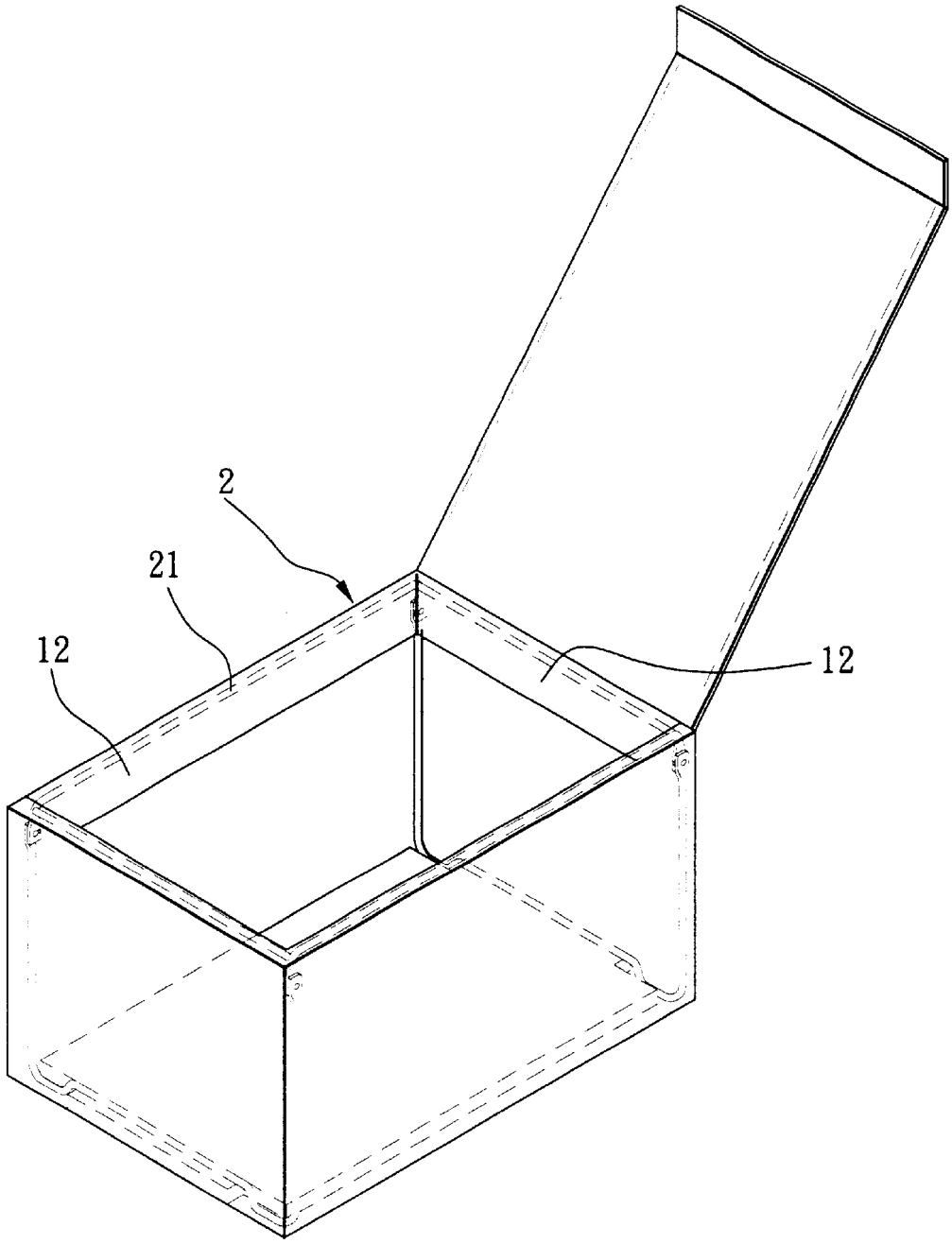
FIG. 2 is a perspective view of the present invention showing the combination storage box opened.

Referring to FIGS. 1 and 2, a combination storage box is shown comprised of a collapsible box body 1, a folding collapsible support frame 2, and a hard bottom plate 3.

Referring to FIGS. 1 and 1A, the collapsible box body 1 is made of flexible face material (for example, canvas) by stitches, comprising four upright peripheral side panels 11 connected to one another and disposed at four sides, four top flaps 12 respectively extended from the top sides of the four upright peripheral side panels 11, a hook material 13 fixedly provided at the inner side of each of the top flaps 12, a loop material 14 fixedly provided at the inner side of each of the four upright peripheral side panels 11 adjacent to the top flaps 12 and adapted for fastening the hook material 13 to secure the top flaps 13 to the inner surfaces of the upright peripheral side panels 11 respectively, and a cover panel 15 extended from the top side of one upright peripheral side panel 11 outside the corresponding top flap 12 and adapted for closing the top opening defined within the four upright peripheral side panels 11. The folding collapsible support frame 2 is adapted for inserting into the collapsible box body 1 to support the collapsible box body 1 in shape, comprising a rectangular open base frame 21, and two U-shaped foot frame bars 22 respectively pivoted to the two short sides of the rectangular open base frame 21. The rectangular open base frame 21 comprises two pairs of downward lugs 210 respectively downwardly extended from the ends of the two opposite short sides. The downward lugs 210 each have a positioning groove 211. The U-shaped foot frame bars 22 each have two distal ends respectively pivoted to the downward lugs 210 of the rectangular open base frame 21 by a respective pivot 23 (see FIG. 1A), an engagement portion 221 at each of the two distal ends, and two protruded foot portions 25 at the ends of the transversely extended middle section thereof (see FIG. 1). The bottom plate 3 fits the horizontal cross section of the holding space defined within the upright peripheral side panels 11 of the collapsible box body 1, having four notches 31 in the four corners thereof for the positioning of the protruded foot portions 25 of the folding collapsible support frame 2 (see FIG. 1).

The assembly process of the present invention is easy and outlined hereinafter with reference to FIGS. 1, 1A, and 2. The bottom plate 3 is inserted into the collapsible box body 1 and supported on the bottom panel of the collapsible box body 1, and then the U-shaped foot frame bars 22 of the folding collapsible support frame 2 are respectively turned outwards from the rectangular open base frame 21 to force the respective engagement portions 221 into engagement with the respective positioning grooves 211, keeping the U-shaped foot frame bars 22 maintained perpendicular to the rectangular open base frame 21, and then the folding collapsible support frame 2 is inserted into the collapsible box body 1 to force the protruded foot portions 25 into engagement with the notches 31 of the bottom plate 3, and then the top flaps 12 are respectively turned inwards and covered over the four sides of the rectangular open base frame 21 to force the hook material 12 into engagement with the loop material 14 and to secure the rectangular open base frame 21 to the inside wall of the collapsible box body 1.

Figure 3:
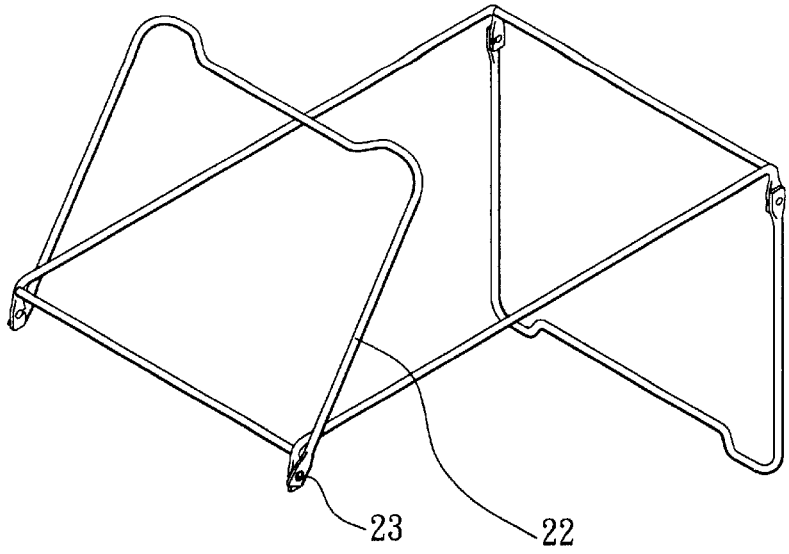
FIG. 3 shows the collapsing action of the folding collapsible support frame according to the present invention (I).
Figure 4:
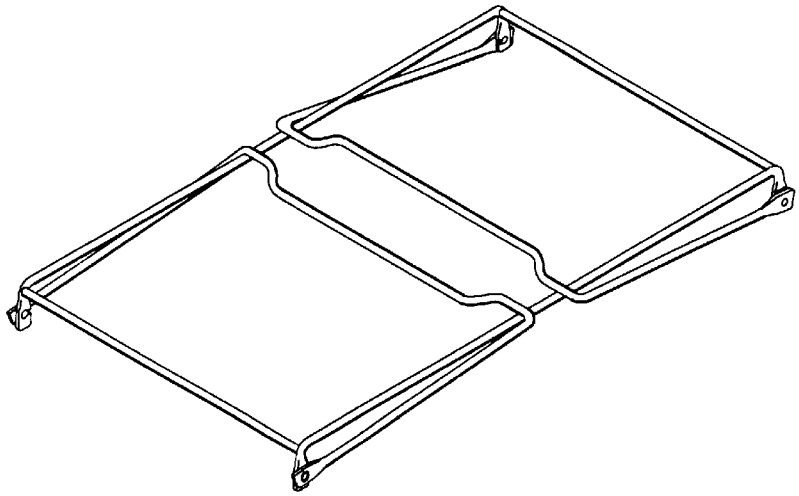
FIG. 4 shows the collapsing action of the folding collapsible support frame according to the present invention (II).

Referring to FIGS. 3 and 4, after removal of the folding collapsible support frame 2 from the collapsible box body 1, the U-shaped foot frame bars 22 of the folding collapsible support frame 2 are respectively turned inwards and closely attached to the rectangular open base frame 21, and therefore the folding collapsible support frame 2 is received in a collapsed flat manner to reduce storage space.

Figure 5:
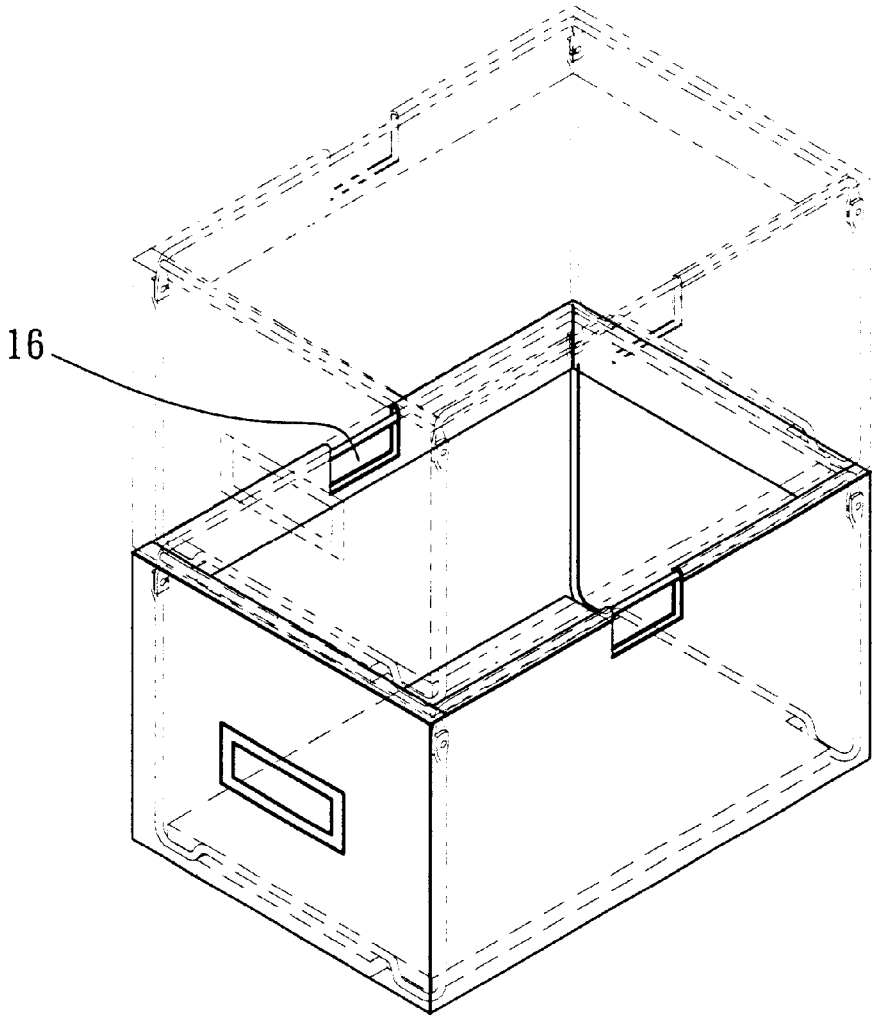
FIG. 5 shows an alternate form of the combination storage box.

FIG. 5 shows an alternate form of the present invention. This alternate form eliminates the aforesaid cover panel 15, and has two hand holes 16 at two sides of the collapsible box body 1 (see also FIG. 1). The hand holes 16 form with the two opposite long sides of the rectangular open base frame 21 of the folding collapsible support frame 2 a respective handle through which the combination storage box is conveniently carried with the hands.

A prototype of combination storage box has been constructed with the features of the annexed drawings of FIGS. 1 through 5. The combination storage box functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A combination storage box comprising a collapsible box body, said collapsible box body having a horizontal bottom panel and four upright peripheral side panels defining with said horizontal bottom panel a rectangular top-open holding space, a hard bottom plate fitted into said collapsible box body and supported on the horizontal bottom panel of said collapsible box body, a folding collapsible support frame inserted into said collapsible box body to support said collapsible box body in shape, hook and loop materials fixedly provided in said collapsible box body and adapted for securing said folding collapsible support frame in position, wherein:

said bottom plate has four notches in four corners thereof;

said folding collapsible support frame comprises a rectangular open base frame, said rectangular open base frame comprising two pairs of downward lugs respectively downwardly extended from two distal ends of each of two opposite short sides thereof, said downward lugs each having a positioning groove, and two U-shaped foot frame bars respectively pivoted to said downward lugs and turned relative to said rectangular base open frame between a first position where said U-shaped foot frame bars are closely attached to said rectangular open base frame and a second position where said U-shaped foot frame bars are maintained perpendicular to said rectangular base frame and arranged in parallel, said U-shaped foot frame bars each comprising two engagement portions at two distal ends thereof adapted for engaging the positioning grooves of said downward lugs to hold said U-shaped foot frame bars in said second position and two protruded foot portions disposed at two ends of a transversely extended middle section thereof and adapted for engaging the notches of said bottom plate after insertion of said folding collapsible support frame into said collapsible box body to support said collapsible box body in shape.

* * * * *